United States Patent [19]

Donnelly et al.

[11] 4,242,081

[45] Dec. 30, 1980

[54] OIL BURNER PRIMARY CONTROL FOR INTERRUPTED IGNITION SYSTEM

[75] Inventors: Donald E. Donnelly, Edwardsville, Ill.; William B. Feero, St. Louis County, Mo.

[73] Assignee: Emerson Electric Co., St. Louis, Mo.

[21] Appl. No.: 17,584

[22] Filed: Mar. 5, 1979

[51] Int. Cl.[3] ..... F23N 5/08

[52] U.S. Cl. ..... 431/71; 431/79; 307/117

[58] Field of Search ..... 307/117, 154; 328/26, 328/74; 431/45, 46, 71, 72, 73, 74, 78, 79, 80, 264; 361/253, 263; 315/209 R, 209 SC, 219

[56] References Cited

U.S. PATENT DOCUMENTS

| | | | |
|---|---|---|---|
| 3,732,433 | 5/1973 | Lourigan | 307/117 |
| 3,947,219 | 3/1976 | Santo | 431/79 |
| 3,975,136 | 8/1976 | Baysinger | 431/74 |

*Primary Examiner*—L. T. Hix
*Assistant Examiner*—S. D. Schreyer
*Attorney, Agent, or Firm*—Paul A. Becker, Sr.

[57] ABSTRACT

An oil burner primary control in an interrupted ignition burner control system includes a miniature coupling transformer for controlling operation of the igniter. The gate circuit of a flame responsive switch is effective, in the absence of a burner flame, to generate a plurality of gating pulses at a frequency substantially greater than line frequency. The flame responsive switch is cyclically gated on by the pulses for energizing a safety switch resistance heater. The primary winding of the coupling transformer is connected in the gate circuit of the flame responsive switch and is responsive to the gating pulses to induce voltage pulses in its secondary winding which is connected in the gate circuit of an ignition switch controlling the igniter. At least one of the pulses occurs sufficiently early in each half cycle of the sine wave alternating current appearing at the ignition switch so that the ignition switch conducts during essentially all of the sine wave, as long as there is no burner flame. When burner flame appears, the pulses are terminated, de-energizing the safety switch resistance heater and the igniter.

12 Claims, 1 Drawing Figure

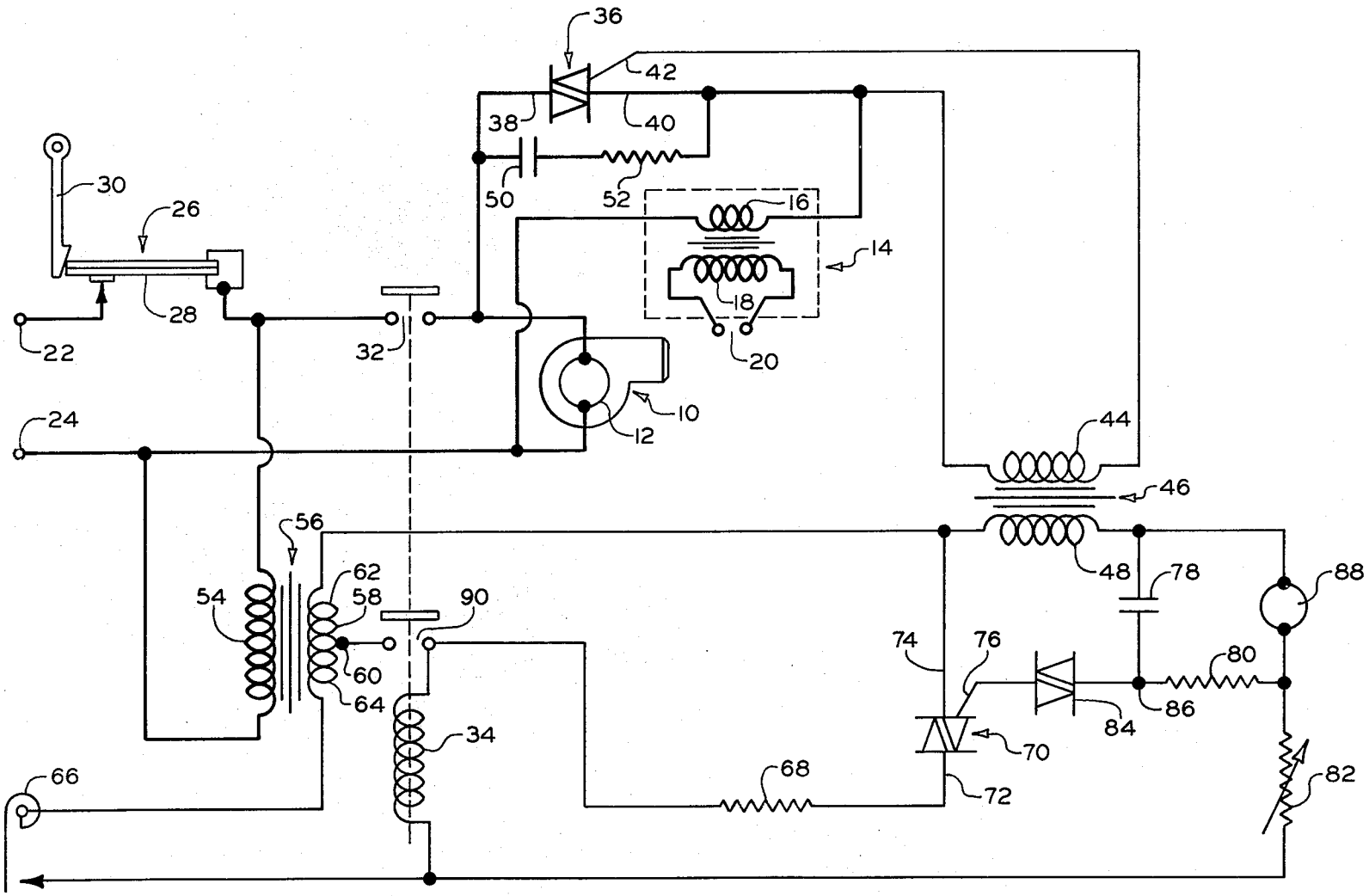
88
82
80
86
78
46
44
48
84
70
76
72
74
14
16
18
20
68
10
12
42
40
52
36
38
50
90
34
32
62
58
60
64
56
54
26
28
30
22
24
66

OIL BURNER PRIMARY CONTROL FOR INTERRUPTED IGNITION SYSTEM

This invention relates to electrically operated burner control systems in which fuel is supplied to a burner and an igniter is operated for a timed trial ignition period, in which fuel flow is continued and the igniter is de-energized in response to the appearance of a burner flame, and in which fuel is cut off and the igniter is de-energized if combustion fails to occur within the trial ignition period.

In burner control system wherein fuel flows to a main burner and ignition is attempted at the same time, a timed trial ignition period is provided to prevent accumulation of large amounts of unburned fuel in the combustion chamber. To provide such a trial ignition period, such systems often employ a thermally operated safety switch comprising a resistance heater and a set of contacts movable to an open position in response to sufficient heating of the resistance heater. The resistance heater is generally energized by a low voltage source through a switch which is conductive in the absence of flame and non-conductive when flame appears. In such systems, if ignition does not occur within the timed trial ignition period, the safety switch contacts open, de-energizing the entire system.

The length of the trial ignition period is adjusted by the manufacturer of the control equipment. However, there are many factors, such as voltage source variations, ambient temperatures, and tolerances or performance variations in circuit component values, which cause the length of the trial ignition period to vary from the value set by the manufacturer. While the manufacturer has little control over some such factors and some variation in timing is acceptable, it is desirable to minimize the time period variations by omitting from the safety switch resistance heater circuit, any components that may be required for some control function but have no direct function regarding trial ignition timing.

In burner control systems of the so-called interrupted ignition type, wherein the igniter is operated for only a portion of the burner-on cycle, a common prior art approach for effecting timely de-energizing of the igniter is to de-energize the igniter in direct response to the appearance of burner flame. While various prior art arrangements may accomplish the desired result, they either involve adding components, for accomplishing this function, to the safety switch resistance heater circuit whereby trial ignition timing may be adversely effected, or they involve adding a large number of components outside the safety switch resistance heater circuit, making the entire system more complex and expensive.

An object of this invention, therefore, is to provide a generally new and improved primary control for controlling the operation of an interrupted ignition system wherein means for effecting timely de-energizing of the igniter upon the appearance of burner flame is outside of the safety switch resistance heater circuit and is particularly economical in construction.

A further object is to provide an improved primary control for controlling the operation of an interrupted ignition system in which a flame responsive switch is gated on, for providing a timed trial ignition period, by one of a plurality of pulses generated in the absence of a burner flame; in which the primary winding of a miniature coupling transformer is connected in the gate circuit of the flame responsive switch and is energized by the plurality of pulses; in which the secondary winding of the coupling transformer is connected in the gate circuit of an ignition switch controlling operation of the igniter; and in which the secondary winding of the coupling transformer is responsive to the pulses induced therein by the primary winding for effecting conduction of the ignition switch.

A further object is to provide a primary control as characterized in the preceding paragraph in which the pulses are generated at a frequency substantially greater than that of the applied alternating current frequency of 60 cycles per second, and in which one of the pulses occurs early in each half cycle of the sine wave of the alternating current flow through the ignition switch. A further object is to provide a primary control as characterized in the penultimate paragraph wherein a safety switch resistance heater for providing the timed trial ignition period is connected in circuit with the flame responsive switch and is energized when the flame responsive switch is conducting, the level of energizing of the resistance heater being independent of electrical energy content of the pulses.

Yet a further object is to provide a burner and ignition control system for enabling energizing of the igniter in the absence of flame and de-energizing of the igniter in the presence of flame wherein a controlled solid state switch in a line voltage circuit controls energizing of the igniter, wherein circuit means in a low voltage circuit is responsive to the absence of flame to generate a plurality of pulses at a frequency substantially greater than 60 cycles per second, wherein a miniature transformer couples the low voltage and line voltage circuits and is responsive to the pulses to control conduction of the switch, and wherein at least one of the pulses occurs early in the sine wave of the current flow through the switch so that, regardless of the phase angle of the current flow as determined by the impedance characteristics of the igniter, the switch conducts during essentially all of the sine wave.

These and other objects and advantages of the present invention will become apparent from the following description when read in connection with the accompanying drawing.

The single FIGURE of the drawing is a schematic illustration of an interrupted ignition burner control system constructed in accordance with the present invention.

DESCRIPTION OF THE PREFERRED EMBODIMENT

Referring to the drawing, the system comprises an oil burner 10 having an electric motor 12 operative to supply fuel and air to burner 10, an ignition transformer 14 having a primary winding 16 and a secondary winding 18, and a pair of spaced spark electrodes 20 disposed adjacent burner 10. The burner motor 12 is connected across alternating current power terminals 22 and 24 in series with a normally closed thermally operated safety switch 26 having a bimetal blade 28 and a pivoted latch 30, and a set of normally open contacts 32 of a relay having a winding 34. The ignition transformer primary winding 16 is connected in parallel with burner motor 12 and in series with a controlled solid state ignition switch comprising a triac 36 having main terminals 38 and 40 and a gate terminal 42.

The secondary winding 44 of a miniature coupling transformer 46 is connected between the gate 42 and main terminal 40 of triac 36. When the primary winding 48 of coupling transformer 46 is sufficiently energized, the induced voltage and accompanying current in the secondary winding 44 causes triac 36 to be gated on, as will be hereinafter described. Preferably, coupling transformer 46 has a 1:1 turns ratio and a small ferrite core, giving an inductance of approximately 750 microhenrys.

A capacitor 50 and a resistor 52 are series connected across main terminals 38 and 40 of triac 36 to provide initial hold-in current for triac 36 as will also be hereinafter described.

The primary winding 54 of a voltage step-down-transformer 56 is connected across power terminals 22 and 24 through the safety switch 26. The secondary winding 58 of transformer 56 has a center tap at 60 which divides the secondary winding 58 into an upper portion 62 and a lower portion 64.

Relay winding 34 is connected across the entire secondary winding 58 in series with a space thermostat 66, a resistance heater 68 associated with safety switch 26, and a flame responsive switch in the form of a solid state switch comprising a triac 70 having main terminals 72 and 74 and a gate 76.

A capacitor 78, a fixed resistor 80, an adjustable resistor 82, and primary winding 48 of coupling transformer 46 are connected in series across triac 70. A voltage breakdown device comprising a diac 84 is connected between the gate 76 of triac 70 and a point 86 between capacitor 78 and resistor 80. A photoconductive cell 88, having an extremely high electrical resistance in the absence of light and considerably less resistance when impinged by the light of the burner flame, is connected across capacitor 78 and resistor 80. In the absence of burner flame, practically all of the voltage output of secondary winding 58 of transformer 56 appears across the high resistance cell 88 and thus across capacitor 78 and resistor 80. This condition enables capacitor 78 to charge to the firing voltage of diac 84. In the presence of burner flame, the resistance of cell 88 is considerably lower than the resistance of resistor 82 so that practically all of the voltage output of secondary winding 58 appears across resistor 82. Under this condition, capacitor 78 is effectively shunted and thus prevented from charging to the firing voltage of diac 84.

In addition to controlling contacts 32, relay winding 34 also controls another set of normally open contacts 90 which, when closed, provide a hold-in circuit for relay winding 34 through contacts 90, the lower portion 64 of secondary winding 58, and thermostat 66. The closing of contacts 90 also completes a circuit across the upper portion 62 of secondary winding 58 through contacts 90, safety switch resistance heater 68, and triac 70.

OPERATION

Under normal operating conditions, closing of space thermostat 66 upon a cell for burner operation effects the series connection of thermostat 66, resistor 82, photoconductive cell 88, and primary winding 48 of coupling transformer 46 across the entire secondary winding 58 of transformer 56. Because there is no burner flame, cell 88 is of extremely high resistance, much greater than the resistance of resistor 82 and the impedance of primary winding 48. Therefore, practically all of the voltage across secondary winding 58 appears across cell 88, enabling capacitor 78 to charge through resistors 82 and 80 and primary winding 48. Because of the large voltage appearing across capacitor 78 and because of a small RC time constant, capacitor 78 rapidly charges to the diac firing voltage, between 6 and 10 volts, and diac 84 becomes conductive.

With diac 84 conducting, capacitor 78 discharges through diac 84 and through the gate 76 and main terminal 74 of triac 70, turning on triac 70, and through primary winding 48 of coupling transformer 46. When diac 84 conducts, the current flow therethrough includes the discharge current of capacitor 78 and a current flow from said secondary winding 58 through resistors 82 and 80. Diac 84 conducts until the current flow therethrough falls below its hold-in value, at which time diac 84 again becomes non-conductive.

The current flow through diac 84 from secondary winding 58 is preferably limited by the resistance of resistors 82 and 80 so that it, by itself, is insufficient to provide the hold-in current required to maintain diac 84 conductive. Thus, diac 84 becomes non-conductive when the discharge current from capacitor 78 is insufficient to provide the hold-in current. It should be noted that even if the current flow from secondary winding 58 is slightly more than the diac hold-in value, diac 84 is assured of being turned off due to the inherent oscillating between capacitor 78 and primary winding 48.

With diac 84 again non-conductive, capacitor 78 again charges and fires the diac. Since capacitor 78 charges rapidly, as previously described, and discharges rapidly because of the low impedance of primary winding 48, diac 84 is turned on and off a number of times, approximately five to ten times, during each half cycle of the alternating current sine wave generated by secondary winding 58 of transformer 56. The resulting increase and decrease of current through the primary winding 48, occurring each time diac 84 is turned on and off, is quite rapid. This causes a plurality of voltage pulses to be induced in the primary winding 48. These pulses induce the same number of pulses in the secondary winding 44 of coupling transformer 46 for a purpose to be hereinafter described.

When triac 70 is gated on, a circuit is completed across the entire secondary winding 58 of transformer 56 through thermostat 66, relay winding 34, safety switch resistance heater 68, and triac 70, causing both sets of normally open relay contacts 32 and 90 to be closed. Once triac 70 is gated on, it remains on until the current flow therethrough drops below its hold-in value. When that occurs, triac 70 becomes non-conductive until it is again gated on by capacitor 78 and diac 84. Because of the previously described manner of operation of diac 84, triac 70 is cyclically gated on early in each half cycle of the alternating current sine wave being applied thereto. Therefore, triac 70 is essentially on all the time, as long as there is no burner flame.

The closing of relay contacts 90 connects relay winding 34 across the lower portion 64 of secondary winding 58 through thermostat 66 and contacts 90 to provide a hold-in circuit for relay winding 34. This hold-in circuit prevents de-energizing of the relay winding 34 when triac 70 is no longer gated on.

The closing of relay contacts 90 also connects safety switch resistance heater 68 and triac 70 across the upper portion 62 of secondary winding 58. Safety switch resistance heater 68 begins to heat to provide a timed trial ignition period.

The closing of relay contacts 32 connects the burner motor 12 across the power source terminals 22 and 24 through safety switch 26 and relay contacts 32 to initiate flow of fuel and air to burner 10.

In the manner previously described, a plurality of pulses are induced in the secondary winding 44 of coupling transformer 46. Each of these pulses is of sufficient voltage and generate sufficient current to gate triac 36 on. Therefore, when relay contacts 32 initially close, triac 36 becomes conductive. With triac 36 conducting, ignition transformer 14 is energized and sparking occurs at electrodes 20 to ignite the fuel and air mixture. These conditions persist until either combustion of the fuel and air mixture occurs or until the safety switch 26 opens.

To enable triac 36 to turn on, it is necessary that there be a sufficient hold-in current flow through triac 36 when triac 36 is gated on. Due to the highly inductive properties of the primary winding 16 of ignition transformer 14, the current from power source terminals 22 and 24 does not begin to flow through triac 36 immediately when triac 36 is gated on. To provide an immediate current flow through triac 36, capacitor 50 and resistor 52 are employed. The values of capacitor 50 and resistor 52 are such that they provide triac 36 with sufficient hold-in current immediately upon the triac 36 being gated on and until sufficient hold-in current flows from the power source terminals 22 and 24. It should be noted that capacitor 50 and resistor 52 would not be required when an electrical resistance igniter is used, since there would be no delay in current flow with a purely resistive igniter.

By providing a plurality of gating pulses to triac 36, the effect of a phase difference between a single gating pulse and the sine wave alternating current appearing at triac 36 is negated. A plurality of pulses ensures that a gating pulse will occur early in each half of the sine wave of the current appearing at triac 36 so that triac 36 will conduct during essentially all of the sine wave, as long as gating pulses continue to be generated. This condition ensures sufficient energizing of ignition transformer 14. This condition also ensures sufficient energizing of other igniters, such as electrical resistance igniters, which effect different voltage-current phase angles at triac 36.

Under normal operation, combustion occurs well within the timed trial ignition period. When burner flame appears, the resistance of the photoconductive cell 88 immediately drops sufficiently to shunt capacitor 78 and thus prevent capacitor 78 from charging to the breakdown voltage of diac 84. With diac 84 off, triac 70 is also off so that the safety switch resistance heater 68 is de-energized.

With diac 84 off and capacitor 78 being prevented from charging to the diac firing voltage, pulses no longer appear in primary winding 48 of coupling transformer 46. The resistance of resistor 82 and cell 88 is sufficiently greater than the impedance of primary winding 48 so that an extremely small value of voltage appearing across primary winding 48 is insufficient to enable secondary winding 44 to effect gating of triac 36. Thus, when burner flame appears, triac 36 is no longer gated on so that the ignition transformer 14 is de-energized. Since relay winding 34 remains energized, contacts 32 remain closed and burner motor 12 remains energized. Under normal operations, these conditions persist until thermostat 66 opens to de-energize relay winding 34.

If combustion fails to occur, the bimetal blade 28 of the safety switch 26 will wrap upwardly due to heating of the safety switch resistance heater 68 which occurs when triac 70 is conducting, and effect the opening of the safety switch 26. When safety switch 26 opens, the trial ignition period is terminated and the entire system is de-energized. Latch 30 in safety switch 26 prevents automatic re-closing of safety switch 26 as the safety switch resistance heater 68 cools, thus requiring a manual unlatching or resetting of the safety switch 26 to enable attempting another burner operation.

If during normal burner operation the electrical power fails, the relay winding 34 is de-energized, causing the burner motor 12 to be de-energized. Upon resumption of electrical power, the burner motor 12 and ignition transformer 14 are controlled in the same manner as previously described for a normal operation.

If during normal burner operation the flame is extinguished for any reason, the photoconductive cell 88 immediately responds to the absence of burner flame and enables capacitor 78 to again charge to the firing voltage of diac 84. Under these conditions, the burner motor 12 remains energized but triac 70 again becomes conductive to enable the safety switch resistance heater 68 to be energized, and diac 84 again effects gating of triac 36 whereby re-ignition is quickly attempted. It requires less than one second for the system to attempt this re-ignition.

It is recognized that primary winding 48 of coupling transformer 46 could be connected in series with resistance heater 68 and accomplish the function of gating triac 36 on in the absence of burner flame. In such an arrangement, the primary winding 48 would be energized whenever triac 70 is conductive and could provide, by adding a filter circuit to the secondary winding 44, a constant gating signal to triac 36. However, such an arrangement could adversely effect the length of the trial ignition period. In the arrangement of this invention, energizing of resistance heater 68 is not effected by the energy content of the pulses through primary winding 48 since the circuit components for energizing resistance heater 68 include only the upper portion 62 of secondary winding 58 of transformer 56 and triac 70. Also, since the coupling transformer 46 in this invention is subjected to pulses rather than a conventional line frequency alternating current flow, it can be made quite small in size.

While a preferred embodiment of the present invention has been illustrated and described in detail in the drawing and foregoing description, it will be recognized that many changes and modifications will occur to those skilled in the art. It is therefore intended, by the appended claims, to cover any such changes and modifications as fall within the true spirit and scope of the invention.

We claim:

1. In a control system for enabling energizing of an electrically operable device under a first condition and deenergizing thereof under a second condition, first circuit means including a triac for controlling energizing of said device by an alternating current power source;

second circuit means responsive to said first condition for generating a plurality of pulses at a frequency substantially greater than that of said alternating current power source and responsive to said second condition for preventing generating of said pulses; and a coupling transformer having a primary winding in said second circuit means and a secondary winding in said first circuit means responsive to said pulses for controlling conduction of said triac, at least one of said pulses occurring early in each half of the sine wave of an alternating current from said power source appearing at said triac so that said triac is conductive during essentially all of said sine wave.

2. In an electrically operated control system for controlling operation of a fuel burner and an ignition device wherein said ignition device is rendered operative in the absence of a burner flame and inoperative in the presence of said burner flame, and wherein a controlled solid state switch controls energizing of said ignition device by an alternating current power source, the improvement comprising a coupling transformer having a primary winding and a secondary winding, circuit means, independent of said switch and including said primary winding, responsive to said absence of said burner flame for generating a plurality of pulses in said primary winding at a frequency substantially greater than that of said alternating current power source, said pulses inducing the same number of pulses in said secondary winding, and circuit means, connected to said switch and including said secondary winding, responsive to said pulses induced in said secondary winding for controlling conduction of said switch.

3. The control system claimed in claim 2 wherein said switch is a triac and at least one of said pulses induced in said secondary winding occurs early in each conductive half cycle of said triac.

4. In an electrically operated control system for controlling operation of a fuel burner and an ignition device, first circuit means including a safety switch for energizing said fuel burner to initiate flow of fuel;

second circuit means including said safety switch and a first controlled solid state switch for energizing said ignition device;

a coupling transformer having a primary winding and a secondary winding;

third circuit means including said secondary winding for gating said first controlled solid state switch on;

fourth circuit means including said primary winding, a second controlled solid state switch, and gating circuit means for said second controlled solid state switch responsive to the absence of a burner flame for providing a plurality of pulses through said primary winding for energizing said third circuit means and for effecting conduction of said second controlled solid state switch; and fifth circuit means for providing a timed trial ignition period during which fuel flows and said ignition device is energized including said second controlled solid state switch and a resistance heater associated with said safety switch.

5. The control system claimed in claim 4 wherein said plurality of pulses occurs within each half cycle of a 60 cycle per second alternating current source.

6. The control system claimed in claim 4 wherein said first controlled solid state switch is a triac, and one of said plurality of pulses occurs early in each half of a sine wave alternating current appearing at said triac so that said triac conducts during essentially all of said sine wave alternating current.

7. The control system claimed in claim 4 wherein said second controlled solid state switch is a triac, and said gating circuit means includes a capacitor, a voltage breakdown device, and a photoconductive cell, said plurality of pulses being generated by repeated discharging of said capacitor through said voltage breakdown device, the gate terminal of said triac, and said primary winding.

8. The control system claimed in claim 7 wherein said voltage breakdown device is a diac, and said diac is maintained conductive by said discharging of said capacitor.

9. In an electrically operated control system for controlling operation of a fuel burner and an ignition device, an alternating current power source;

a voltage step-down transformer having a primary winding connected across said power source and a secondary winding;

a relay having a winding energized by said secondary winding upon demand for heat and effective for connecting said fuel burner across said power source to initiate flow of fuel;

circuit means including a first triac connected in parallel with said fuel burner and effective when said first triac is conductive for energizing said ignition device to ignite said fuel;

a coupling transformer for controlling conduction of said first triac comprising a first portion connected in circuit with said secondary winding and a second portion connected in a gating circuit for said first triac;

timing circuit means including a set of contacts in series with said alternating current power source and a resistance heater;

a second triac for connecting said resistance heater across said secondary winding; and gating circuit means for said second triac including said first portion of said coupling transformer for generating a plurality of pulses in the absence of a burner flame, said pulses being effective for gating said second triac on whereby said resistance heater is energized, and effective for energizing said first portion of said coupling transformer whereby said second portion thereof becomes effective to gate said first triac on.

10. In an electrically operated control system for controlling operation of a fuel burner and an ignition device, an alternating current power source;

a voltage step-down transformer having a primary winding connected across said power source and a secondary winding; a relay having a winding energized by said secondary winding upon demand for heat and effective for connecting said fuel burner across said power source to initiate flow of fuel;

circuit means including a first triac connected in parallel with said fuel burner and effective when said first triac is conductive for energizing said ignition device to ignite said fuel;

a coupling transformer for controlling conduction of said first triac comprising a first portion connected in circuit with said secondary winding and a second portion connected in a gating circuit for said first triac;

timing circuit means including a set of contacts in series with said alternating current power source and a resistance heater;

a second triac for connecting said resistance heater across said secondary winding;

gating circuit means for said second triac including said first portion of said coupling transformer for generating a plurality of pulses in the absence of a burner flame;

said pulses being effective for gating said second triac on whereby said resistance heater is energized, and effective for energizing said first portion of said coupling transformer whereby said second portion thereof becomes effective to gate said first triac on;

said gating circuit means further including a photoconductive cell connected across said secondary winding and having high electrical resistance in said absence of said burner flame, a capacitor connected in parallel with said cell whereby said capacitor charges in said absence of said burner flame, and a voltage breakdown device connected in circuit with said capacitor and rendered conductive when said capacitor attains a sufficient charge; and said first portion of said coupling transformer being connected in series with said capacitor, said voltage breakdown device, and the gate terminal of said second triac, said capacitor effecting conduction and non-conduction of said voltage breakdown device a plurality of times during each half cycle of a voltage applied thereto from said secondary winding for generating said pulses.

11. The control system claimed in claim 10 wherein said capacitor effects said conduction and non-conduction of said voltage breakdown device at least 5 times during said each half cycle of a voltage applied thereto.

12. The control system claimed in claim 11 wherein a capacitor and a resistor are connected across the main terminals of said first triac for providing a hold-in circuit when said first triac is initially gated on.

* * * * *